US006583348B2

(12) United States Patent
Hasegawa et al.

(10) Patent No.: US 6,583,348 B2
(45) Date of Patent: Jun. 24, 2003

(54) SERVER FOR USE IN RATING OF MUSIC CONTENTS

(75) Inventors: Yutaka Hasegawa, Hamamatsu (JP); Shinji Koezuka, Hamamatsu (JP); Nobuo Tsunashima, Hamamatsu (JP); Masaya Okura, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/953,048

(22) Filed: Sep. 12, 2001

(65) Prior Publication Data

US 2002/0029684 A1 Mar. 14, 2002

(30) Foreign Application Priority Data

Sep. 13, 2000 (JP) ..... 2000-278857

(51) Int. Cl.[7] ..... G04B 13/00; G10H 7/00

(52) U.S. Cl. ..... 84/609; 84/615; 84/649; 84/653

(58) Field of Search ..... 84/600–603, 609–610, 84/615–616, 649–650, 653–654, 470 R, 477 R

(56) References Cited

U.S. PATENT DOCUMENTS 6,211,451 B1 * 4/2001 Tohgi et al. ..... 84/470 R
6,346,666 B1 * 2/2002 Tsai et al. ..... 84/470 R
6,417,435 B2 * 7/2002 Chantzis et al. ..... 84/477 R

* cited by examiner

*Primary Examiner*—Marlon T. Fletcher
(74) *Attorney, Agent, or Firm*—Morrison & Foerster LLP

(57) ABSTRACT

A server apparatus is provided for conducting an evaluation of a music piece with an external terminal apparatus. In the apparatus, a communication unit is used to exchange information with the external terminal apparatus. A first transmitting section transmits first prompt information to the external terminal apparatus through the communication unit, the first prompt information being effective to prompt a first evaluation of a music piece. A second transmitting section transmits inquiry information to the external terminal apparatus through the communication unit, the inquiry information inquiring whether or not to proceed with a second evaluation of the music piece. A receiving section receives request information from the external terminal apparatus in response to the inquiry information through the communication unit, the request information requesting the second evaluation. A third transmitting section transmits second prompt information to the external terminal apparatus in response to the request information through the communication unit, the second prompt information being effective to prompt the second evaluation of the music piece.

9 Claims, 12 Drawing Sheets

SERVER FOR USE IN RATING OF MUSIC CONTENTS

BACKGROUND OF THE INVENTION

1. Field of the Invention

The present invention relates generally to a music evaluation system comprising a WWW (World Wide Web) server for supplying HTML (Hyper Text Markup Language) documents and WWW terminals such as PCs (Personal Computers) and PDAs (Personal Digital Assistants) for browsing the HTML documents and XML (Extensible Markup Language) documents, wherein the WWW server prompts the WWW terminals for the auditioning and evaluation of music pieces by use of HTML documents.

2. Description of Related Art

Today, with the recent great strides in telecommunication technologies, so-called Internet Web services are in widespread use where HTML documents and XML documents supplied by WWW servers are browsed at personal computers, mobile phones, and other WWW terminals by use of software programs called browsers. One of such Internet Web services is the auditioning and evaluation of music contents at WWW terminals. In this service, a Web site supplied by the WWW server has plural pieces of auditioning music (namely, music play data for reproducing a part of music) corresponding to respective pieces of music. Each WWW terminal downloads the play data from the WWW server and auditions desired music pieces, evaluates the auditioned music in accordance with evaluation points (for example, melody point, lyrics point, singing skill point, and playing skill point) prepared at the Web site, and transmits evaluation results to the WWW server.

However, in the above-mentioned music evaluation technique, each WWW terminal must mark all prepared evaluation items. The evaluation of all auditioned pieces of music is an extremely complicated procedure, so that many users come to score only the favorite pieces of music among those auditioned. Consequently, the WWW server may obtain evaluation of only a part of many pieces of music provided for auditioning.

SUMMARY OF THE INVENTION

It is therefore an object of the present invention to provide a music evaluation apparatus, a music evaluation system and a storage medium, which can control music evaluation in two steps of simple evaluation and detailed evaluation in a stepwise manner.

According to the invention, a server apparatus is provided for conducting an evaluation of a music piece with an external terminal apparatus. In the apparatus, a communication unit Is used to exchange information with the external terminal apparatus. A first transmitting section transmits first prompt information to the external terminal apparatus through the communication unit, the first prompt information being effective to prompt a first evaluation of a music piece. A second transmitting section transmits inquiry information to the external terminal apparatus through the communication unit, the inquiry information inquiring whether or not to proceed with a second evaluation of the music piece. A receiving section receives request information from the external terminal apparatus in response to the inquiry information through the communication unit, the request information requesting the second evaluation. A third transmitting section transmits second prompt information to the external terminal apparatus in response to the request information through the communication unit, the second prompt information being effective to prompt the second evaluation of the music piece.

In a preferred form, the inventive server apparatus further comprises a database that stores a plurality of music pieces, and a data transmitting section that transmits data of a music piece selected from the database to the external terminal apparatus, so that the selected music piece can be auditioned at the external terminal apparatus for the evaluation. In such a case, the data transmitting section transmits first data of the selected music piece effective to perform a short auditioning of the selected music piece in the first evaluation, and transmits second data of the selected music piece effective to perform a long auditioning of the selected music piece for the second evaluation.

In a preferred form, the first transmitting section transmits the first prompt information effective to prompt the first evaluation for quickly evaluating the music piece, and the third transmitting section transmits the second prompt information effective to prompt the second evaluation for more thoroughly evaluating the music piece than the first evaluation. In such a case, the evaluation of the music piece is completed quickly by the first evaluation alone when the receiving section fails to receive the request information in response to the inquiry information.

Consequently, the novel constitution can increase the willingness of each user for music evaluation through the simple evaluation method to obtain the evaluation of all auditioned pieces of music and to obtain the detailed evaluation through the detailed evaluation method as well.

BRIEF DESCRIPTION OF THE DRAWINGS

These and other objects of the invention will be seen by reference to the description, taken in connection with the accompanying drawings, in which.

DETAILED DESCRIPTION OF PREFERRED EMBODIMENTS

Figure 1:
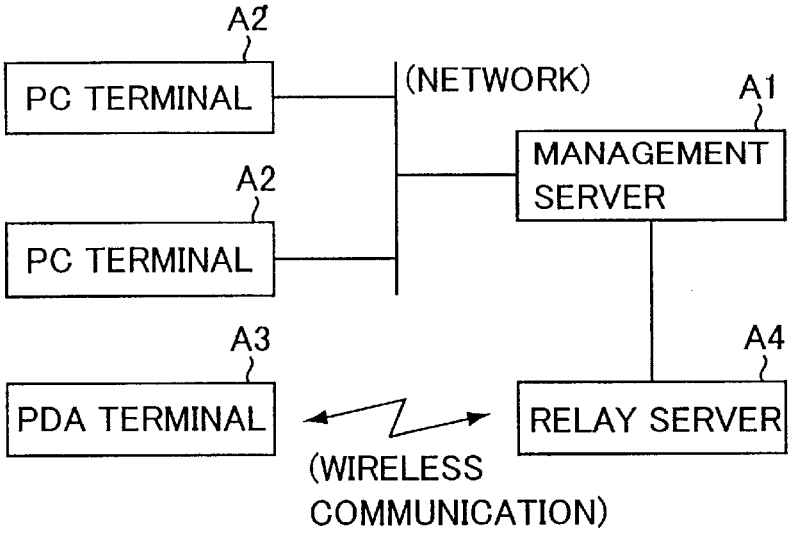
FIG. 1 is a block diagram illustrating an overview of a system according to the invention.

This invention will be described in further detail by way of example with reference to the accompanying drawings. Now, referring to FIG. 1, there is shown a block diagram illustrating an overview of a music evaluation system according to the invention. As shown, the music evaluation system comprises a management server A1 (a WWW server) for supplying an Internet Web service for prompting music auditioning and evaluation, and a PC (Personal Computer) terminal A2 for performing music auditioning and evaluation by use of this Internet Web service, both being interconnected by a wired or wireless network such as the Internet for transferring various information necessary for the music auditioning and evaluation.

The management server A1 can provide Internet Web services to two or more PC terminals A2. The terminals which use the provided Internet Web services include PDA terminals A3 such as mobile phones which can transfer information with the management server A1 in a wireless manner. The PDA terminals A3 are connected to the management server A1 via a relay server A4 for wireless communication. Also, the terminals which use the Internet Web services provided by the management server A1 may be other terminals than the PC terminal A2 and the PDA terminal A3. Namely, any terminals are available that can be connected to the management server A1 for exchanging information during evaluation processing is executed.

Figure 2:
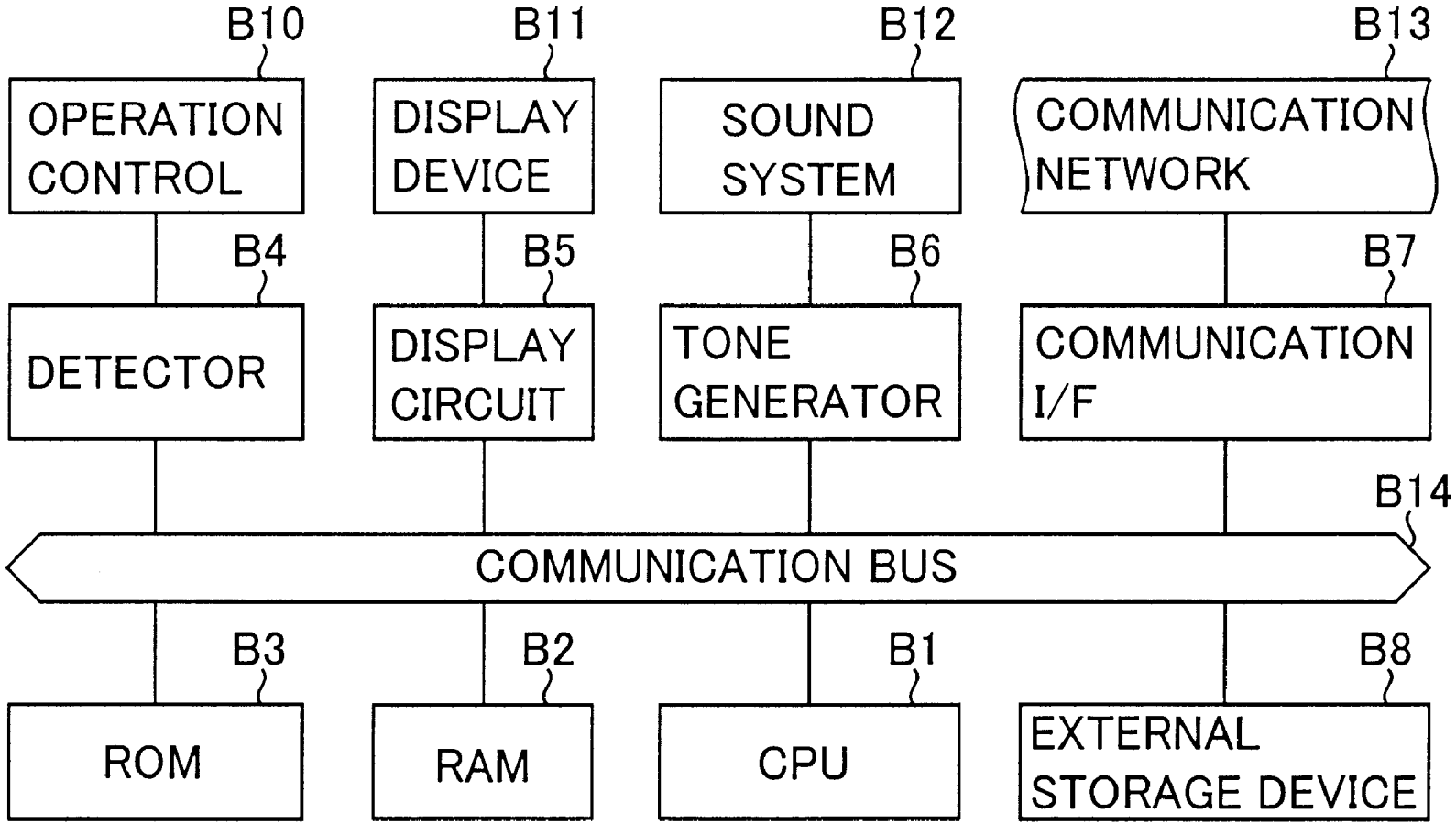
FIG. 2 is a block diagram illustrating a general hardware configuration of a management server according to the invention.

Referring to FIG. 2, there is shown a block diagram illustrating a general hardware configuration of the management server A1 associated with the invention.

The management server A1 comprises a CPU B1, a RAM B2, a ROM B3, a detector B4, a display circuit B5, a tone generator B6, a communication interface B7, and an external storage device B8 interconnected by a communication bus B14.

The CPU B1 performs computation and control operations in accordance with control programs and various information (HTML documents and XML documents for providing Internet Web services) stored in the ROM B3 or the external storage device B8 and other information required from terminals (PC terminal A2 and PDA terminal A3).

The RAM B2 provides a work area to be used as flags and registers by the CPU B1, and stores the information supplied from terminals. The ROM B3 stores the control programs and various information necessary for providing Internet Web services and the pieces of auditioning music (actually, the music play data for auditioning) corresponding to respective pieces of music.

The play data for auditioning is used to reproduce the music instrument play and vocal singing play corresponding to a certain part of music, and may be data of any formats such as Web file and SMF (Standard MIDI File). An SMF cannot record the data associated with the singing play, so that it may be used in combination with a Web file. It is also desirable that the music play data contain a text file recording lyrics information.

The detector B4 is connected to an operation control B10 and is used for compiling the evaluation information collected from terminals and add music information for auditioning and evaluation. The operation control B10 includes a keyboard, a mouse, dedicated switches, and other devices with which the user operates to input various information.

The display circuit B5 is connected to a display device B11 which displays various information such as the score information received from terminals.

The tone generator B6 is connected to a sound system B12, generates music tone signals corresponding to the music play data, and controls the sound system B12 so as to play music in accordance with the generated tone signals, which is used for checking music pieces.

The communication interface B7 is connectable to a communication network B13 such as a LAN (Local Area Network), the Internet, or a public switched phone network, through which the interface B7 receives various information (for example, request information and evaluation information) from terminals, and transmits various information (for example, HTML documents and XML documents) to terminals.

The external storage device B8 includes an interface for external storage. Through this interface, the external storage device B8 is connected to the bus B14. The external storage device B8 is a floppy disk drive (FDD), a hard disk drive (HDD), a magneto-optical (MO) drive, a CD-ROM (Compact Disc Read Only Memory) drive, a DVD (Digital Versatile Disc) drive, or semiconductor memory, for example. The external storage device B8 can store the control programs for providing Internet Web services and the music play data corresponding to two or more pieces of music. If the ROM B3 stores no control program, the control program can be read from the external storage device B8 to cause the CPU B1 to execute the same processing as is executed by reading the control program from the ROM B3. New control programs and new music play data can be additionally stored in the external storage device B8, thereby upgrading the versions of control programs and newly adding music play data with ease.

The hardware configuration of each of the terminals (the PC terminal A2 and the PDA terminal A3) is generally the same as the management server A1 shown in FIG. 2 and therefore will be described only briefly. In each terminal, CPU stores various information (such as HTML documents and XML documents) received from the management server A1 into RAM and external storage device and executes computation or control operations in accordance with the stored information and the control programs stored in the ROM and external storage device. Each terminal uses its tone generator and sound system to reproduce music pieces on the basis of the music play data supplied from the management server A1. In addition, each terminal uses its display circuit and display device to display various screens for music auditioning and evaluation on the basis of the HTML and XML documents supplied from the management server A1. Then, each terminal transmits various information inputted by use of these screens and operation controls to the management server A1 via a communication interface and a communication network to which the terminal is connected.

Figure 3:
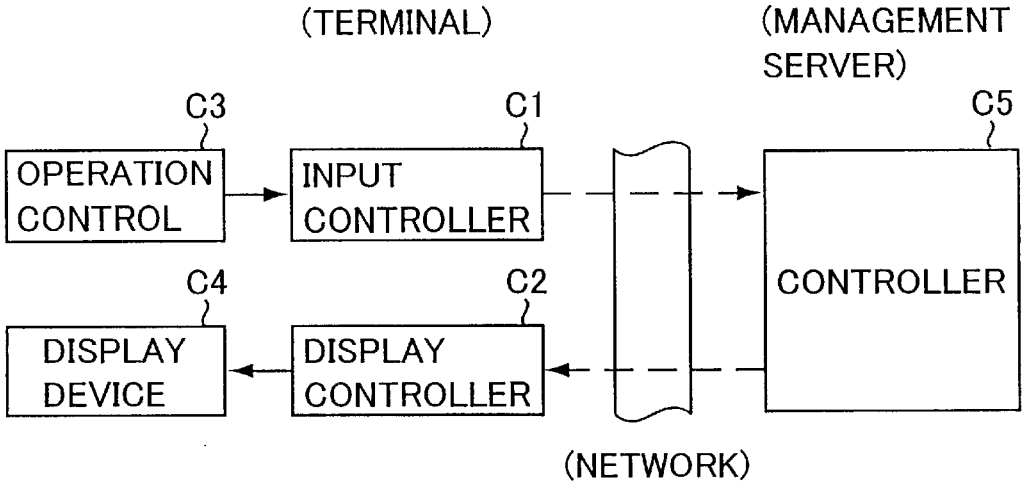
FIG. 3 is a block diagram illustrating a functional concept of the invention.

Referring to FIG. 3, there is shown a block diagram illustrating a concept of a music evaluation system according to the invention. First, when an access to a management server is made through an operation control C3 of a terminal, request information for requesting the management server for the first information (the information associated with a table-of-contents screen HTML and XML documents for example) for executing music auditioning and evaluation prepared in the management server is transmitted to the terminal by the processing of an input control section C1 (to be executed by the CPU, RAM, ROM, detector, and communication interface).

Next, receiving the request signal from the terminal, the management server transmits the requested information (the information associated with a table-of-contents screen) to the terminal by the processing of a controller C5 (to be executed by the CPU, RAM, ROM, and communication interface).

Receiving the requested information from the management server, the terminal executes the processing in accordance with the received information. In this example, the table-of-contents screen is displayed on a display device C4 (a liquid crystal display integrated with the terminal or a display monitor connected thereto) by the processing of a display controller C2 of the terminal side (to be executed by the CPU, RAM, ROM, display circuit, and display device).

The transfer of various information other than the above-mentioned table-of-contents screen between the terminal and the server is executed in the same manner.

The table-of-contents screens (not shown), the first screen to be displayed in the provision of the Internet Web service associated with music auditioning and evaluation, shows a start instruction section for directing the starting of music auditioning and evaluation. The Internet Web service also includes the capabilities of presenting recommended music pieces, popularity rankings of music pieces, and concert schedules. The table-of-contents screen also shows the instruction sections for starting these capabilities.

Then, when the start instruction section for music auditioning and evaluation is operated at the terminal, the management server transmits various information (such as HTML and XML documents) necessary for operating the music auditioning and evaluation capabilities to the terminal, thereby executing these capabilities in the present invention.

The music auditioning and evaluation capabilities allow each terminal to audition and evaluate the music play data supplied from the management server and to transmit back the evaluation results to the server. The music play data is reproduced at the terminal by use of its tone generator and sound system. The evaluation is executed in two steps. In the first auditioning, the music piece is sounded only for a short period of time for a quick evaluation. The user can specify the second, detail auditioning in which the melody, lyrics, singing skill, and playing skill of a particular piece of music are rated. In the detail evaluation, auditioning takes longer than that of the first evaluation. If the user does not want the detail evaluation, he proceeds to a next piece of music for evaluation. This is repeated for the auditioning and evaluation of multiple pieces of music.

The following describes the processing associated with the music auditioning and evaluation capabilities according to the invention with reference to FIGS. 4 through 17.

Figure 4:
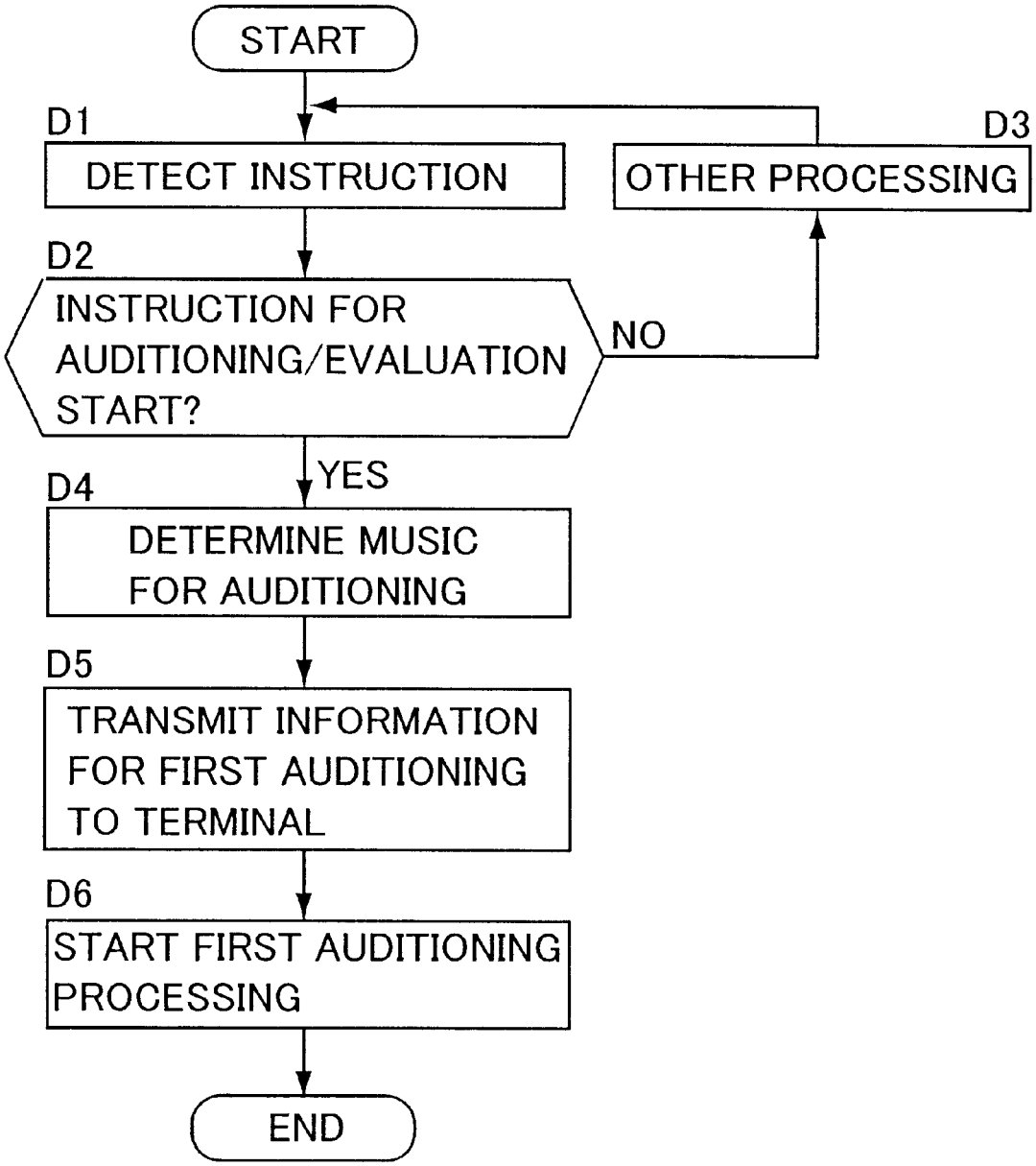
FIG. 4 is a flowchart describing main processing executed by the management server according to the invention.

Referring to FIG. 4, there is shown a flowchart describing the main processing to be started by the management server while the table-of-contents screen is displayed on the terminal. The main processing shown in FIG. 4 starts after the transmission of the table-of-contents screen information upon request from the terminal.

First, the management server checks whether any instruction operation has been made on the table-of-content screen by the terminal (step D1). This check is executed by detecting the request information associated with a instruction operation from the terminal.

If a instruction operation (or request information) is found, the management server determines whether the detected command operation is associated with music auditioning and evaluation (step D2). If the detected instruction operation is not associated with music auditioning and evaluation (NO in step D2), then it indicates the starting of another capability, so that the management server executes the processing corresponding to the detected capability in step D3. If the instruction operation is for the presentation of recommended music, popularity ranking, or concert schedule, the management server transmits various information necessary for displaying a corresponding screen to the terminal.

If the detected instruction operation is found associated with music auditioning and evaluation (YES in step D2), then the management server determines a piece music for auditioning and evaluation to start its auditioning and evaluation (step D4). Because the sequence of the pieces of music for auditioning and evaluation is predetermined, the management server selects a music piece by following this sequence every time a auditioning is specified from the terminal.

Next, the management server transmits the display information for displaying a first auditioning screen associated with the determined piece of music to the terminal (step D5). The terminal displays the first auditioning screen shown in FIG. 5 on the basis of the received display information. The first auditioning is an operation for allowing the user to audition the music piece on the basis of the music play data for a brief period of time before the quick evaluation on a simple grading basis. The first auditioning operation displays the first auditioning screen to prompt the user for starting the auditioning (namely, the reproduction) of music.

Lastly, the management server starts a process (FIG. 6) corresponding to the first auditioning, upon which this main processing comes to an end (step D6).

Figure 5:
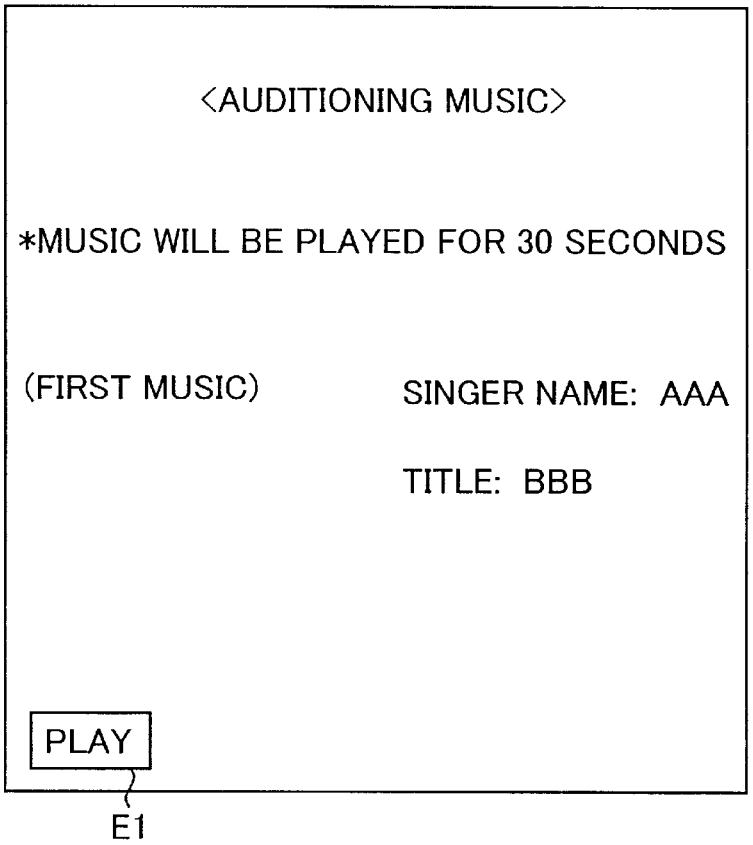
FIG. 5 is an exemplary display screen showing a first auditioning operation displayed on a remote terminal according to the invention.

Referring to FIG. 5, there is shown an exemplary screen of the first auditioning to be displayed on the display device C4 of the terminal. The first auditioning screen shows the title and singer name of the piece of music to be auditioned and to be rated this time, and indicates a start switch E1 for specifying the starting of the auditioning (namely, the reproduction of the music play data). At the terminal, the user operates the start switch E1 through the operation control C3 to request the starting of the first auditioning (to be specific, the terminal transmits the request information for starting the first auditioning to the management server).

Figure 6:
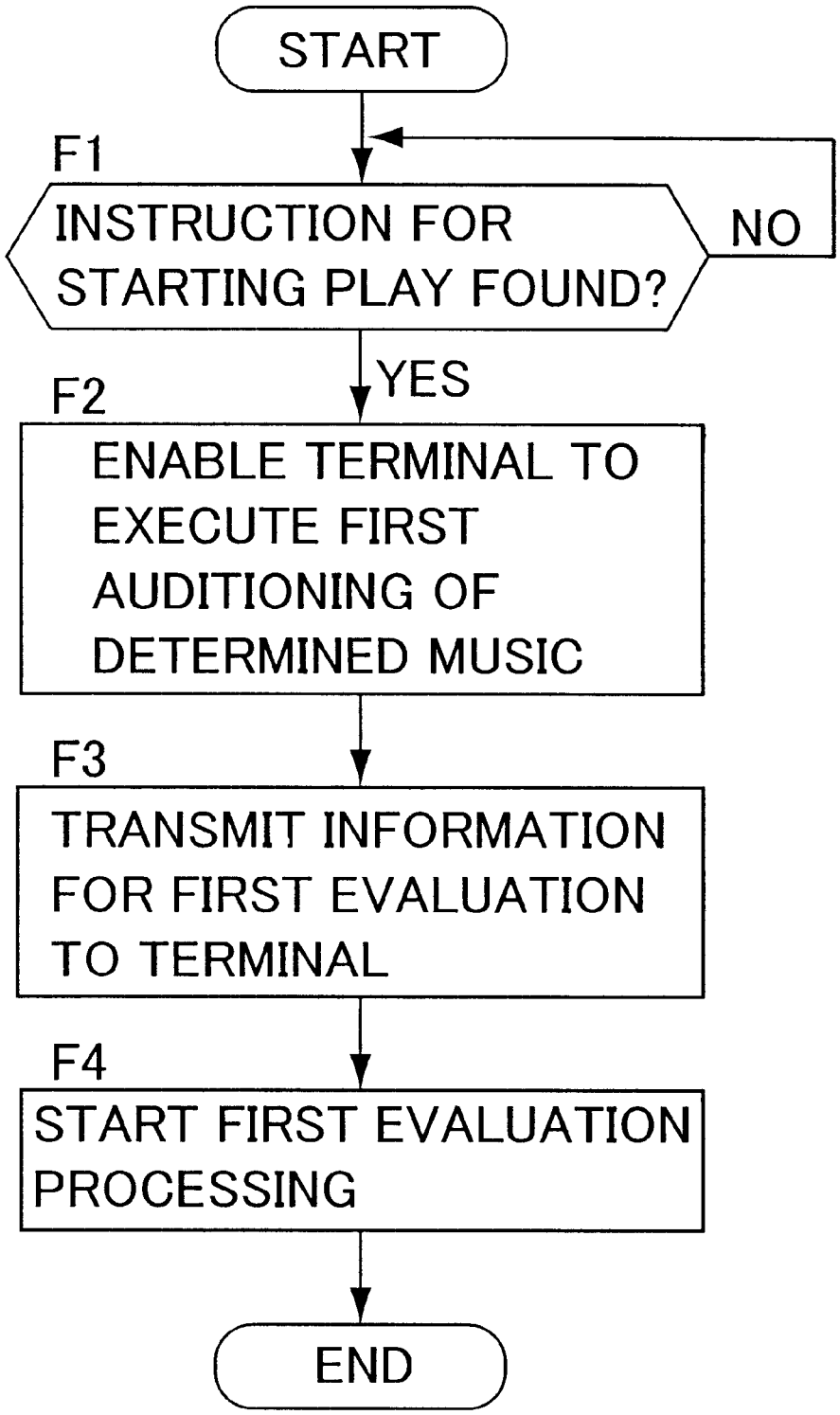
FIG. 6 is a flowchart describing first auditioning processing in the management server according to the invention.

Referring to FIG. 6, there is shown a flowchart describing the first auditioning processing to be started by the management server while the first auditioning screen is displayed on the terminal. First, the management server determines whether the start switch E1 has been operated at the terminal (step F1). The management server makes this determination by receiving the information about the operation from the terminal, and repeats this detection process (namely, determination) until this information is detected (NO in step F1).

Figure 7:
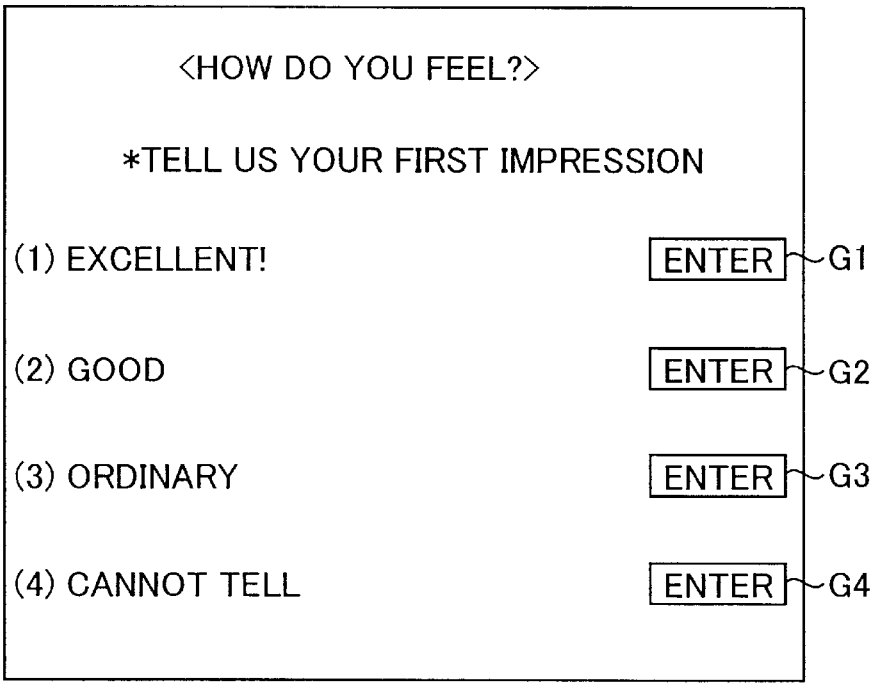
FIG. 7 is an exemplary display screen showing a first evaluation operation displayed on the remote terminal according to the invention.

When the operation of the start switch E1 is detected at the terminal (YES in step F1), then the management server transmits predetermined information to the terminal so as to start the first auditioning of the music piece determined in step D4 shown in FIG. 4 (step F2). In this example, the management server transmits the music play data to the terminal, and lets the terminal repeatedly reproduce the data for only 30 seconds at a time. As this reproduction comes to an end, the management server transmits the display information for displaying a first evaluation screen to the terminal for scoring (the first evaluation) on the basis of the first auditioning (step F3). The terminal displays the first evaluation screen as shown in FIG. 7 on the basis of the received display information. The first evaluation is a quick evaluation operation on a simple grading, prompting the user for a quick evaluation with reference to the first evaluation screen displayed on the terminal. Lastly, the management server starts a process (FIG. 8) for the first evaluation, upon which this first auditioning processing comes to an end (step F4).

Referring to FIG. 7, there is shown an exemplary first evaluation screen to be displayed on the display device C4 of the terminal. The first evaluation screen shows phrases for expressing the grades (or comments) and evaluation enter switches G1 through G4 for letting the user scare the auditioned piece of music. These switches G1 through G4 correspond to user's scares "Excellent," "Good," "Ordinary," and "Cannot Tell" in this order. The entered evaluation is transmitted to the management server (to be specific, the contents correspond to the operated evaluation enter switch is transmitted to the management server as the evaluation information).

Figure 8:
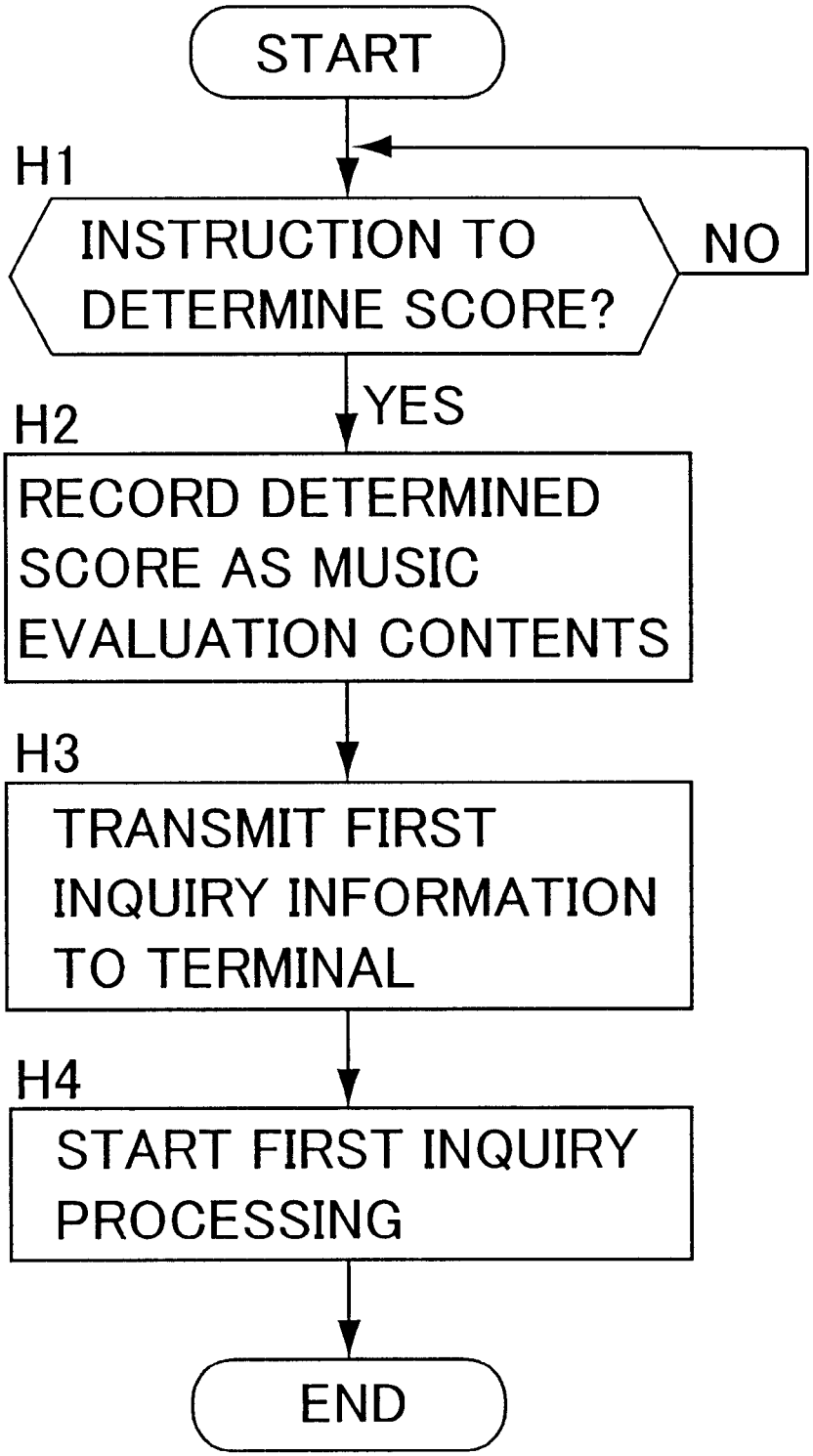
FIG. 8 is a flowchart describing first evaluation processing in the management server according to the invention.

Referring to FIG. 8, there is shown a flowchart describing the first evaluation processing to be started by the management server while the first evaluation screen is displayed on the terminal. First, the management server determines whether any one of the evaluation enter switches G1 through G4 has been operated (step H1). The management server makes this determination on the basis of the reception of the information associated with the operation from the terminal, and repeats this detection process (or determination) until the information is detected (NO in step H1).

When the operation of any one of the evaluation enter switches G1 through G4 at the terminal is detected (YES in step H1), the management server stores the evaluation information (or the contents of the determined evaluation) corresponding to the operated evaluation enter switch into the storage area provided for each piece of music. The evaluation contents are compiled for each piece of music to be used for the rating and the determination of recommended music pieces (step H2).

Then, the management server transmits the display information for displaying a first inquiry screen to the terminal. The terminal displays the first inquiry screen shown in FIG. 9 on the basis of the received display information. The first inquiry asks the user whether to make a second evaluation on the currently selected piece of music.

Lastly, the management server starts a process (FIG. 10) corresponding to the first inquiry, upon which this first evaluation processing comes to an end (step H4).

Figure 9:
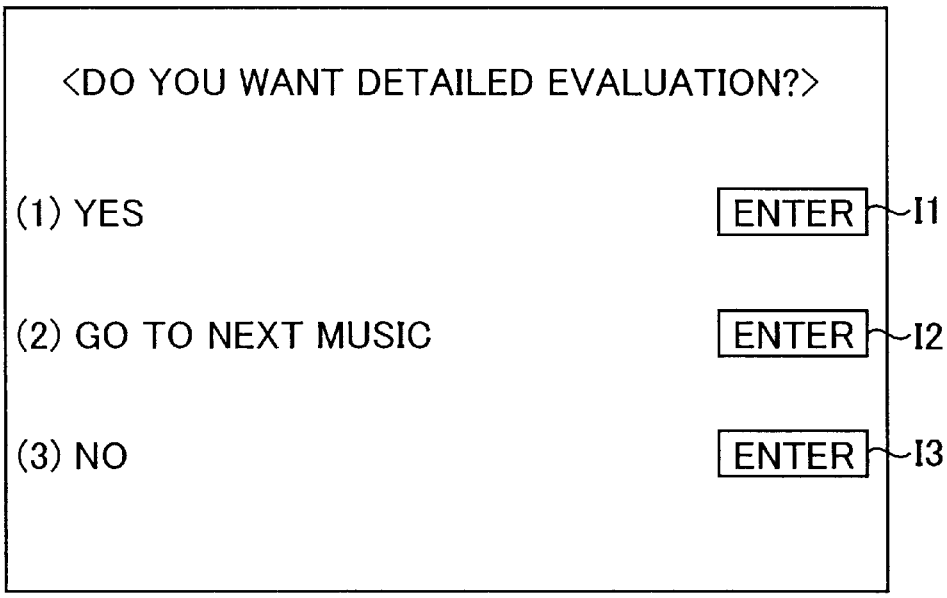
FIG. 9 is an exemplary display screen showing a first inquiry operation displayed on the terminal according to the invention.

Referring to FIG. 9, there is shown an exemplary first inquiry screen to be displayed on the display device C4 of the terminal. The first inquiry screen shows contents of option for determining whether to execute detailed evaluation about the piece of music currently subject to auditioning and evaluation and selection enter switches I1 through I3 for entering the selection made by the user. The selection enter switch I1 indicates the execution of detailed evaluation, the selection enter switch I2 indicates the starting of the evaluation of a next piece of music, and the selection enter switch I3 indicates the ending of auditioning and evaluation.

Figure 10:
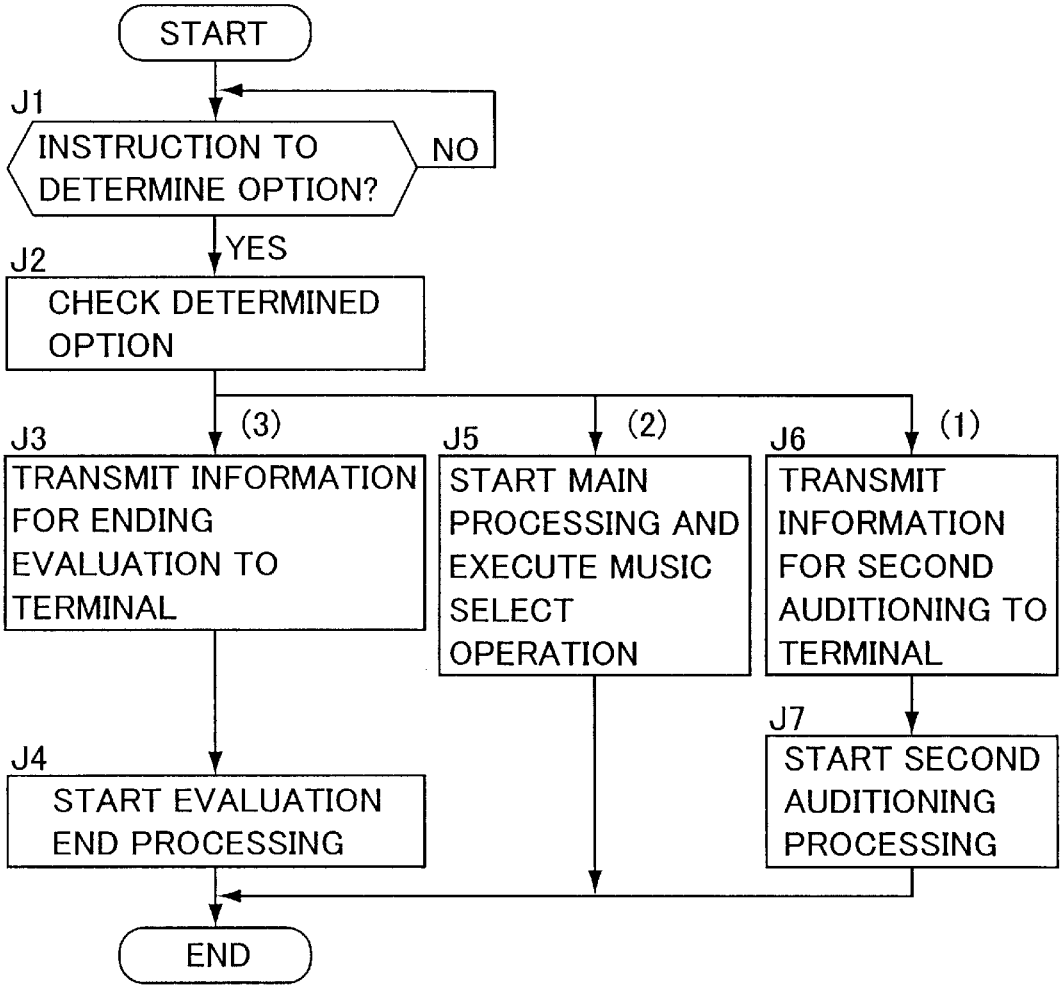
FIG. 10 is a flowchart describing first inquiry processing in the management server according to the invention.

Referring to FIG. 10, there is shown a flowchart describing the first inquiry processing conducted by the management server while the first inquiry screen is displayed on the terminal. First, the management server determines which of the selection enter switch I1 through I3 has been operated at the terminal (step J1). The management server makes this determination on the basis of the reception of the information about the operation from the terminal, and repeats this process until the information is detected (namely, determined) (NO in step J1).

When any one of the selection enter switches I1 through I3 is found operated (YES in step J1), then the management server executes a process corresponding to the content of the operated switch (step J2).

If the selection enter switch I3 is operated at the terminal to indicate the ending of auditioning and evaluation, the management server transmits display information for displaying an evaluation ending screen to the terminal (step J3). The terminal displays the evaluation ending screen shown in FIG. 17 on the basis of the received display information. Then, the management server starts a process (not shown) corresponding to the evaluation, upon which this first inquiring processing comes to an end (step J4).

If the selection enter switch I2 is operated at the terminal to indicate the starting of evaluation of a next piece of music, the management server starts the main processing to execute the auditioning and evaluation of the next piece of music, upon which this first inquiry processing comes to an end (step J5). In step D4 of the main processing, the management server determines the next piece of music for next auditioning and evaluation in accordance with a predetermined sequence. Subsequently, the above-mentioned processes are sequentially executed.

If the selection enter switch I1 is operated at the terminal to indicate the execution of detailed evaluation, the management server transmits display information for displaying a second auditioning screen to the terminal to let the user execute a second auditioning of the currently selected piece of music (step J6). The terminal displays the second auditioning screen shown in FIG. 11 on the basis of the received display information. The second auditioning denotes an operation in which the user auditions the music piece longer than the first auditioning before executing detailed evaluation on the basis of pointing scheme. The second auditioning screen is displayed on the terminal to prompt the user for the starting of auditioning (namely, the reproduction of music play data). Then, the management server starts a process (FIG. 12) for the second auditioning, upon which this first inquiry processing comes to an end (step J7).

Figure 11:
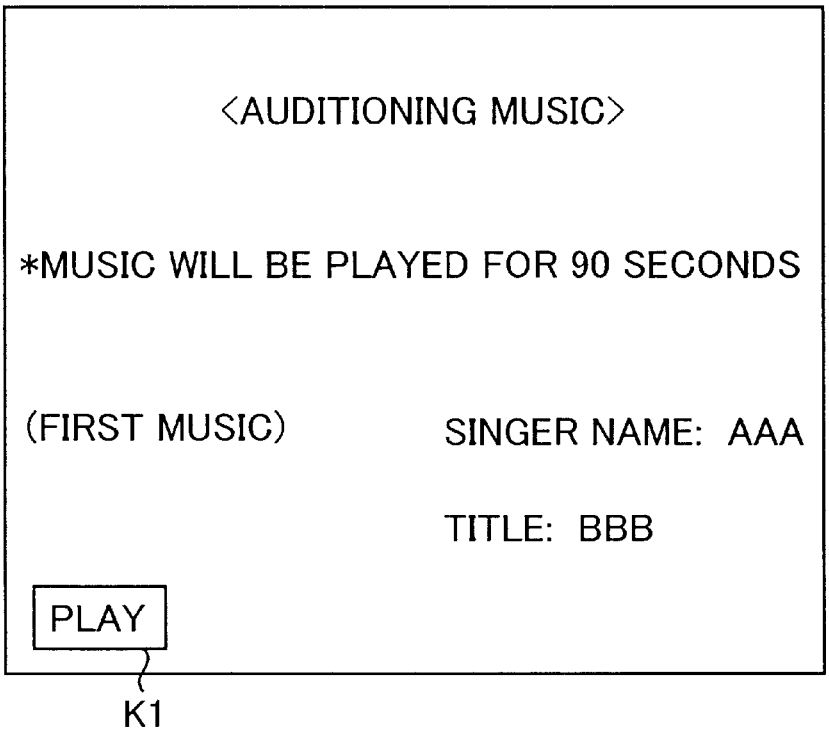
FIG. 11 is an exemplary display screen showing a second auditioning operation displayed on the terminal according to the invention.

Referring to FIG. 11, there is shown an exemplary second auditioning screen to be displayed on the display device C4 of the terminal. The second auditioning screen shows the music title and singer name of a music piece for auditioning and evaluation this time, and a start switch K1 for indicating the starting of auditioning (namely, the reproduction of the music play data). When the user operates the start switch K1 through the operation control C3, the terminal requests the management server for the starting of the second auditioning (namely, the request information for starting the second auditioning is transmitted to the management server).

Figure 12:
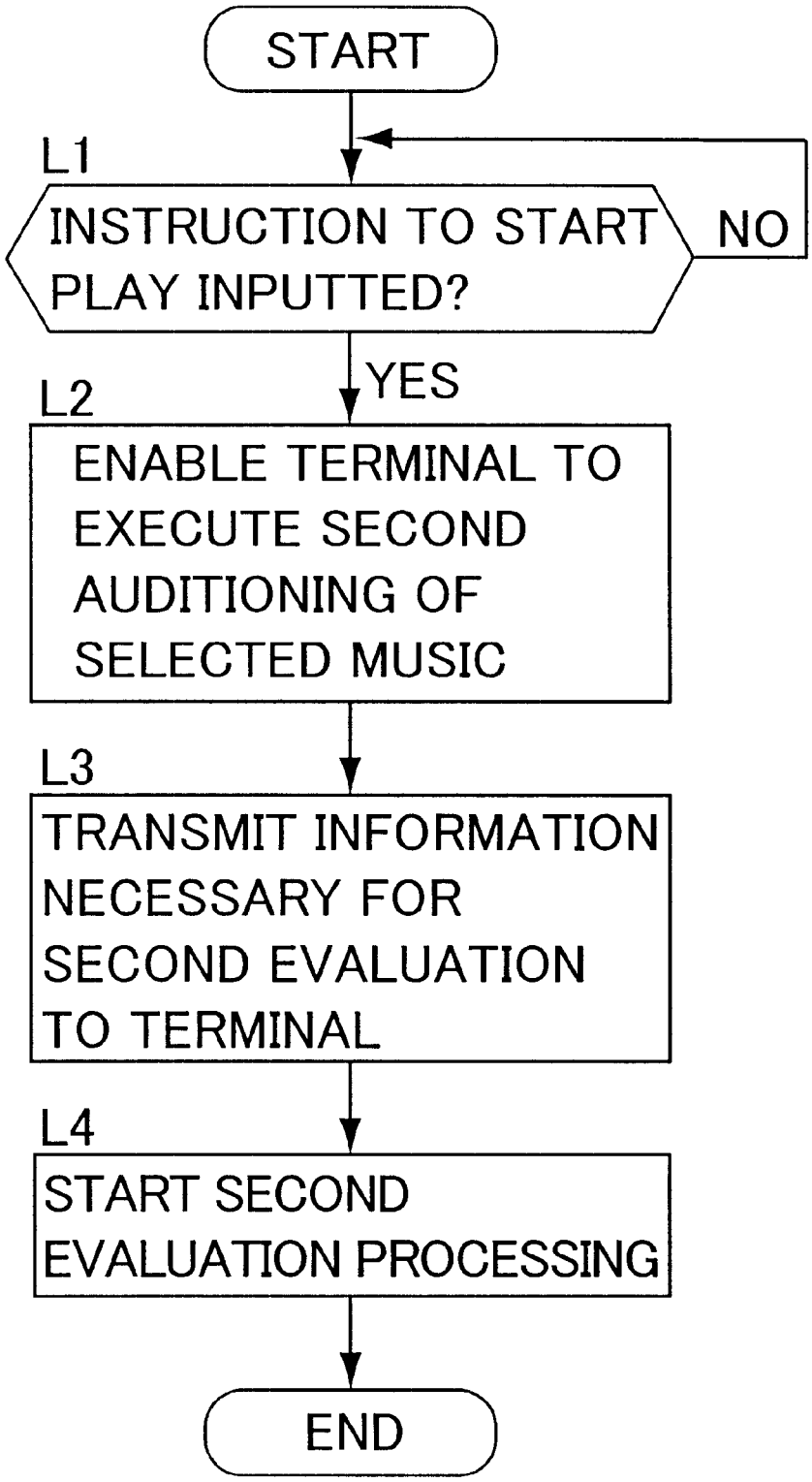
FIG. 12 is a flowchart describing second auditioning processing in the management server according to the invention.

Referring to FIG. 12, there is shown a flowchart describing the second auditioning processing to be started by the management server while the second auditioning screen is displayed on the terminal. First, the management server determines whether the start switch K1 has been operated at the terminal (step L1). The management server makes this determination on the basis of the detection of the information about the operation from the terminal, and repeats the process of the detection (namely, the determination) until the information is detected (NO in step L1).

If the operation of the start switch K1 at the terminal is detected (YES in step L1), the management server transmits predetermined information to the terminal to let the user start the second auditioning of the music piece selected in step D4 shown in FIG. 4 (step L2). In this example, the management server transmits the music play data to the terminal to reproduce the data for 90 seconds at the terminal. As this reproduction ends, the management server transmits display information for displaying a second evaluation screen to the terminal so as to let the user executing the scoring (the second evaluation) for the second auditioning (step L3). The terminal displays the second evaluation screen on the basis of the received display information. The second evaluation denotes a detailed evaluation based on point input scheme, prompting the user for the detailed evaluation with reference to the second evaluation screen displayed on the terminal. Lastly, the management server starts the process for the second evaluation (FIG. 14), upon which this second auditioning processing comes to an end.

Figure 13:
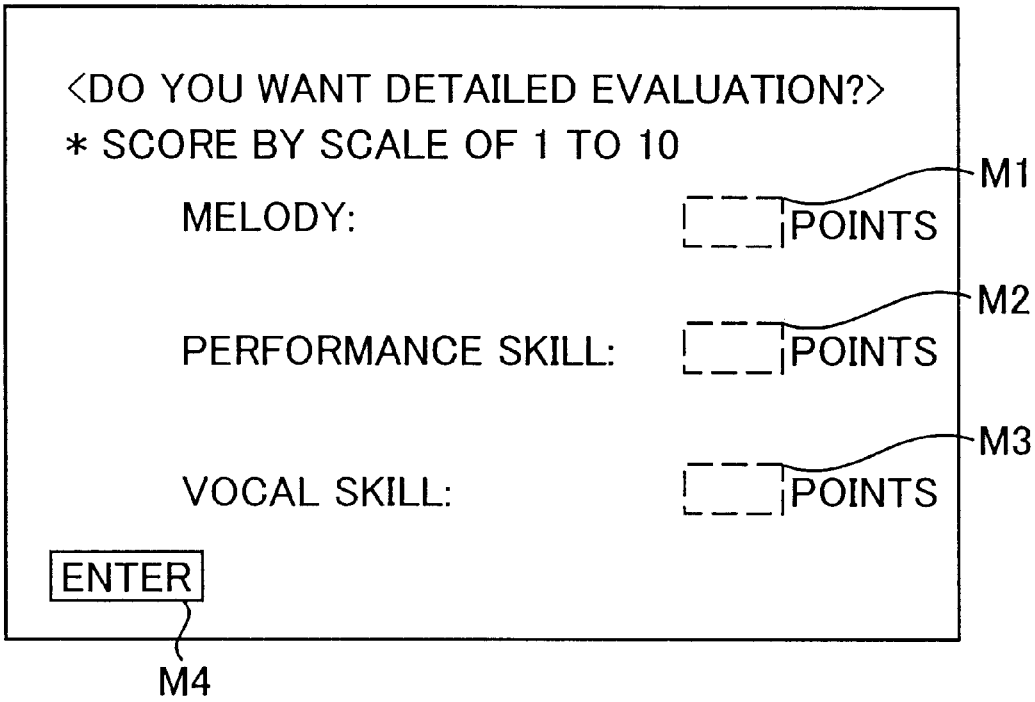
FIG. 13 is an exemplary display screen showing a second evaluation operation displayed on the terminal according to the invention.

Referring to FIG. 13, there is shown an exemplary second evaluation screen to be displayed on the display device C4 of the terminal. The second evaluation screen shows words expressing evaluation items, point input boxes M1 through M3, and an evaluation enter switch M4 for transmitting the results of evaluation to the management server. The user enters a point in each of the point input boxes M1 through M3 provided for respective evaluation items through the operation control C3 of the terminal, and operates the evaluation enter switch M4 to transmit the inputted evaluation contents to the management server. Namely, when the user operates the evaluation enter switch, the points entered in the point input boxes M1 through M3 are transmitted to the management server as the evaluation information.

Figure 14:
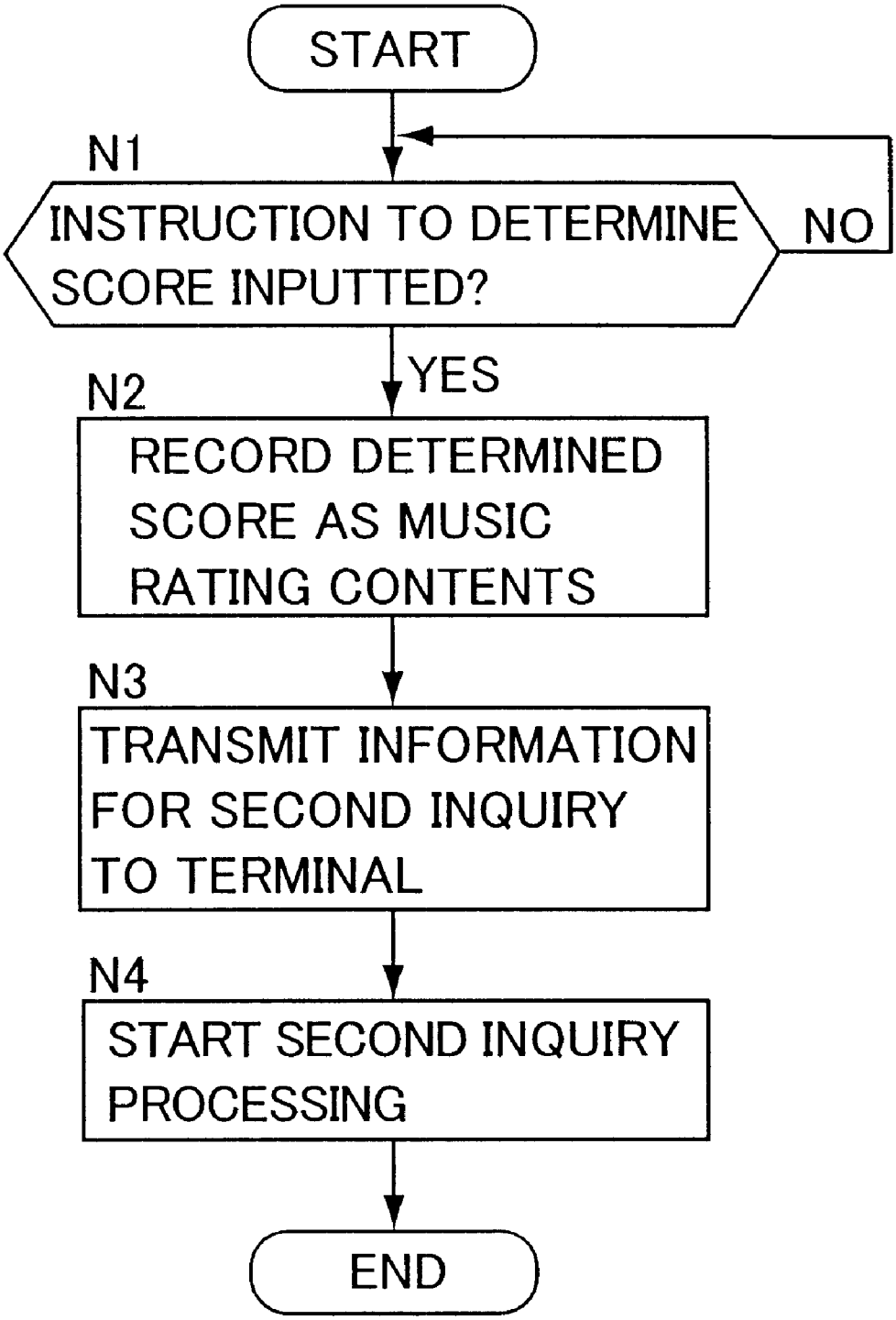
FIG. 14 is a flowchart describing second evaluation processing in the management server according to the invention.

Referring to FIG. 14, there is shown a flowchart describing the second evaluation processing to be started by the management server while the second evaluation screen is displayed on the terminal. First, the management server determines whether the evaluation enter switch M4 has been operated at the terminal (step N1). The management server makes this determination on the basis of the detection of the information about the operation of switches from the terminal, and repeats the process for the detection (namely, the determination) until the information is detected (NO in step N1).

If the operation of the evaluation enter switch M4 at the terminal is detected (YES in step N1), then the management server stores the evaluation information (the entered evaluation contents) corresponding to the evaluation enter switch operated at the terminal into the storage area provided for each piece of music. The evaluation contents, which are transmitted to the management server when the evaluation enter switch M4 is operated at the terminal, include the points (entered in the point input boxes) entered for each evaluation item at the terminal. The evaluation points are compiled for each piece of music for use in the ranking of popularity and the determination of recommended music pieces (step N2).

Then, the management server transmits display information for displaying a second inquiry screen to the terminal (step N3). The terminal displays the second inquiry screen shown in FIG. 15 on the basis of the received display information. The second inquiry asks the user whether to auditioning and rate a next piece of music. Lastly, the management server starts the process for the second inquiry (FIG. 16), upon which this second evaluation processing comes to an end (step N4).

Figure 15:
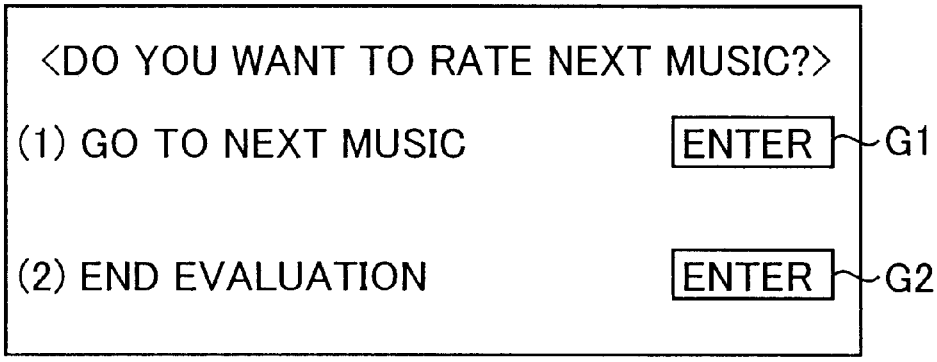
FIG. 15 is an exemplary display screen showing a second inquiry operation displayed on the terminal according to the invention.

Referring to FIG. 15, there is shown an exemplary second inquiry screen to be displayed on the display device C4 of the terminal. The second inquiry screen shows options for determining whether to continue music auditioning and evaluation, and selection enter switches O1 and O2 for entering the option. In this example, the selection enter switch O1 indicates the starting of the auditioning of a next music piece and the other selection enter switch O2 indicates the ending of auditioning and evaluation.

Figure 16:
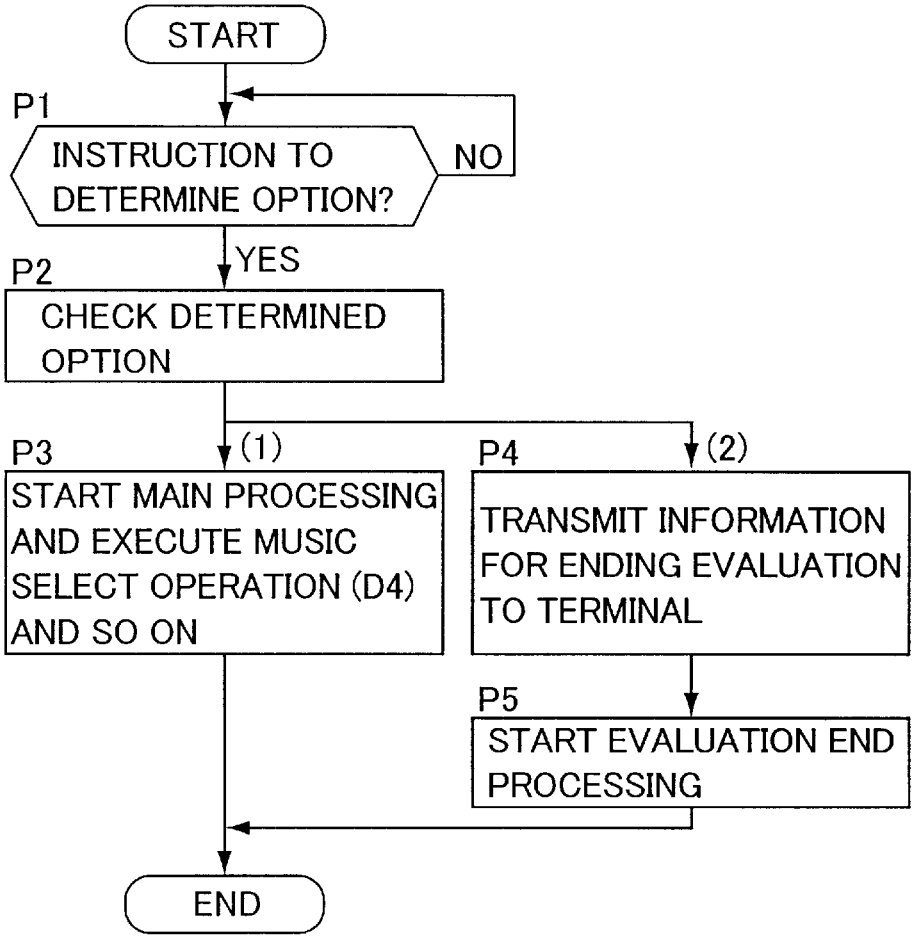
FIG. 16 is a flowchart describing second inquiry processing in the management server according to the invention.

Referring to FIG. 16, there is shown a flowchart describing the second inquiry processing to be started by the management server while the second inquiry screen is displayed on the terminal. First, the management server determines which of the selection enter switches O1 and O2 has been operated (step P1). The management server makes this determination on the basis of the detection of the information about the operation of switches from the terminal, and repeats the process of the detection (namely, the determination) until the information is detected (NO in step P1).

If the operation of either selection enter switch O1 or O2 at the terminal is detected (YES in step P1), the management server determines contents of the operation and executes a corresponding process (step P2).

If the user has specified the starting of a next piece of music by operating the selection enter switch O1, the management server starts the main processing to execute the auditioning and evaluation of the next piece of music, thereby starting the processing with step D4, upon which this second inquiry processing comes to an end (step P3). In step D4 of the main processing, the management server determines a piece of music to be auditioned and rated next in accordance with the predetermined sequence. Subsequently, the above-mentioned processes are sequentially executed.

If the other selection enter switch O2 has been operated at the terminal to indicate the ending of auditioning and evaluation, the management server transmits display information for displaying an evaluation end screen to the terminal to quit the auditioning and evaluation capabilities (step P4). The terminal displays the evaluation end screen shown in FIG. 17 on the basis of the received display information. The management server starts a process (not shown) for evaluation processing, upon which this second inquiry processing comes to an end (step P5).

Figure 17:
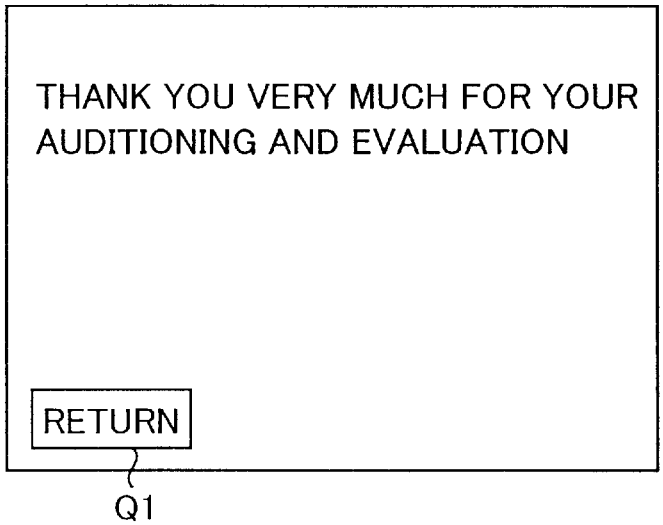
FIG. 17 is a exemplary display screen showing the ending message of evaluation displayed on the terminal according to the invention.

Referring to FIG. 17, there is shown an exemplary evaluation end screen to be displayed on the display device C4 of the terminal. The evaluation end screen shows a return switch Q1 for returning to the table-of-contents screen. When the return switch Q1 is operated, the management server transmits the display information for displaying the table-of-contents screen to the terminal in the evaluation end screen (not shown) started by the management server. Subsequently, the management server starts the main processing to end the evaluation end processing.

As described with reference to step D4 shown in FIG. 4, the pieces of music subject to auditioning and evaluation are predetermined in the present embodiment. It will be apparent to those skilled in the art that the terminal may select, in step D4, the pieces of music subject to auditioning and evaluation instead of using the predetermined pieces of music. One piece of music may be selected for each session of the evaluation or two or more pieces of music may be pre-selected in the order of evaluation.

As described and according to the above-mentioned music evaluation system associated with the invention, those pieces of music interesting the users can be rated in detail, while others not interesting the users in may be evaluated briefly, thereby minimizing the complicated procedure in evaluation work to get the users rate all auditioned pieces of music. In addition, the music evaluation system associated with the invention provides an environment which facilitates the detailed evaluation by playing the interesting music piece longer than uninteresting music pieces, thereby promoting the user's intention for evaluation. Further, the music evaluation system associated with the invention makes it easier for each user to understand the evaluation method, thereby minimizing the complicated procedure in evaluation work to promote the user's intention for evaluation.

While the preferred embodiments of the present invention have been described using specific terms, such description is for illustrative purposes only, and it is to be understood that changes and variations may be made without departing from the spirit or scope of the appended claims.

What is claimed is:

1. A server apparatus for conducting an evaluation of a music piece with an external terminal apparatus, comprising:

a communication unit that is used to exchange information with the external terminal apparatus:

a first transmitting section that transmits first prompt information to the external terminal apparatus through the communication unit, the first prompt information being effective to prompt a first evaluation of a music piece;

a second transmitting section that transmits inquiry information to the external terminal apparatus through the communication unit, the inquiry information inquiring whether or not to proceed with a second evaluation of the music piece;

a receiving section that receives request information from the external terminal apparatus in response to the inquiry information through the communication unit, the request information requesting the second evaluation; and a third transmitting section that transmits second prompt information to the external terminal apparatus in response to the request information through the communication unit, the second prompt information being effective to prompt the second evaluation of the music piece.

2. The server apparatus according to claim 1, further comprising a database that stores a plurality of music pieces, and a data transmitting section that transmits data of a music piece selected from the database to the external terminal apparatus, so that the selected music piece can be auditioned at the external terminal apparatus for the evaluation.

3. The server apparatus according to claim 2, wherein the data transmitting section transmits first data of the selected music piece effective to perform a short auditioning of the selected music piece in the first evaluation, and transmits second data of the selected music piece effective to perform a long auditioning of the selected music piece for the second evaluation.

4. The server apparatus according to claim 1, wherein the first transmitting section transmits the first prompt information effective to prompt the first evaluation for quickly evaluating the music piece, and the third transmitting section transmits the second prompt information effective to prompt the second evaluation for more thoroughly evaluating the music piece than the first evaluation.

5. The server apparatus according to claim 4, wherein the evaluation of the music piece is completed quickly by the first evaluation alone when the receiving section fails to receive the request information in response to the inquiry information.

6. The server apparatus according to claim 1, further comprising another receiving section that receives a result of the first evaluation from the external terminal apparatus through the communication unit.

7. The server apparatus according to claim 6, wherein the second transmitting section transmits the inquiry information to the external terminal apparatus through the communication unit after said another receiving section receives the result of the first evaluation.

8. A method of conducting an evaluation of a music piece by use of a server apparatus while exchanging information with external terminal apparatuses, the method comprising the steps of:

transmitting first prompt information to an external terminal apparatus, the first prompt information being effective to prompt a first evaluation of a music piece;

transmitting inquiry information to the external terminal apparatus, the inquiry information inquiring whether or not to proceed with a second evaluation of the music piece;

receiving request information from the external terminal apparatus in response to the inquiry information, the request information requesting the second evaluation; and transmitting second prompt information to the external terminal apparatus in response to the request information, the second prompt information being effective to prompt the second evaluation of the music piece.

9. A machine readable medium for use in a server apparatus having a processor unit and a communication unit for exchanging information with external terminal apparatuses, the medium containing program instructions executable by the processor unit for causing the server apparatus to conduct a method of evaluating a music piece, wherein the method comprises the steps of:

transmitting first prompt information to an external terminal apparatus, the first prompt information being effective to prompt a first evaluation of a music piece;

transmitting inquiry information to the external terminal apparatus, the inquiry information inquiring whether or not to proceed with a second evaluation of the music piece;

receiving request information from the external terminal apparatus in response to the inquiry information, the request information requesting the second evaluation; and transmitting second prompt information to the external terminal apparatus in response to the request information, the second prompt information being effective to prompt the second evaluation of the music piece.

* * * * *